US010692666B2

(12) United States Patent
Mora

(10) Patent No.: US 10,692,666 B2
(45) Date of Patent: Jun. 23, 2020

(54) EMERGENCY STOP DEVICE

(71) Applicant: APEM, Caussade (FR)

(72) Inventor: Cédric Mora, L'Honor de Cos (FR)

(73) Assignee: APEM (FR)

( * ) Notice: Subject to any disclaimer, the term of this patent is extended or adjusted under 35 U.S.C. 154(b) by 0 days.

(21) Appl. No.: 16/256,149

(22) Filed: Jan. 24, 2019

(65) Prior Publication Data

US 2019/0237277 A1 Aug. 1, 2019

(30) Foreign Application Priority Data

Jan. 26, 2018 (FR) ..... 18 50618

(51) Int. Cl.
*H01H 13/14* (2006.01)
*H01H 13/06* (2006.01)
(Continued)

(52) U.S. Cl.
CPC ..... *H01H 13/14* (2013.01); *H01H 3/022* (2013.01); *H01H 9/02* (2013.01); *H01H 9/22* (2013.01);
(Continued)

(58) Field of Classification Search
CPC ..... H01H 13/14; H01H 13/06; H01H 13/10; H01H 2221/08
(Continued)

(56) References Cited

U.S. PATENT DOCUMENTS 3,239,641 A 3/1966 Pettit
8,003,909 B2 * 8/2011 Gessler ..... H01H 9/167 200/16 A
(Continued)

FOREIGN PATENT DOCUMENTS

DE 2853810 B1 4/1980
EP 2955735 A1 12/2015
(Continued)

OTHER PUBLICATIONS

British Search Report for Application No. GB1900980.2 dated Jul. 3, 2019, 1 page.
(Continued)

*Primary Examiner* — Edwin A. Leon
*Assistant Examiner* — Iman Malakooti
(74) *Attorney, Agent, or Firm* — Lerner, David, Littenberg, Krumholz & Mentlik, LLP

(57) ABSTRACT

The invention relates to an emergency stop device, comprising:

an electric module suited to being soldered onto a printed circuit board (PCB), comprising a body, at least two fixed contacts arranged in the body and at least one contact actuator bearing a moveable contact able to connect said fixed contacts electrically, an actuating module suited to being mechanically coupled to the electric module and to being mounted on a panel (P), the actuating module comprising a body and an actuator moveable with respect to the body, the body comprising a so-called rear part able to extend through the panel (P) on a side opposite to the actuator and to receive the electric module, the actuating module being able to be actuated by an operator between the following positions:

a rest position in which the moveable contact ensures an electrical connection between the fixed contacts, and an activated position in which the actuator exerts a depression force on the contact actuator so as to break the electrical connection between the fixed contacts.

Said device comprises a locking system configured to secure in a reversible manner the mechanical coupling of the electric module to the actuating module.

18 Claims, 8 Drawing Sheets

(51) Int. Cl.

| | |
|---|---|
| ***H01H 9/22*** | (2006.01) |
| ***H01H 9/02*** | (2006.01) |
| ***H01H 3/02*** | (2006.01) |
| ***H01H 13/04*** | (2006.01) |
| ***H01H 13/10*** | (2006.01) |

(52) U.S. Cl.
CPC ..... *H01H 13/04* (2013.01); *H01H 13/06* (2013.01); *H01H 13/10* (2013.01); *H01H 2221/08* (2013.01); *H01H 2225/012* (2013.01)

(58) Field of Classification Search
USPC ..... 200/529
See application file for complete search history.

(56) References Cited

U.S. PATENT DOCUMENTS

| | | | | |
|---|---|---|---|---|
| 2010/0243418 | A1* | 9/2010 | Machida | H01H 3/022 200/341 |
| 2015/0228424 | A1* | 8/2015 | Tallone | H01H 13/28 200/513 |
| 2016/0196933 | A1 | 7/2016 | Wiese et al. | |

FOREIGN PATENT DOCUMENTS

| | | | |
|---|---|---|---|
| JP | 2009266554 | A | 11/2009 |
| WO | 2014202654 | A1 | 12/2014 |

OTHER PUBLICATIONS

French Preliminary Search Report for Application No. FR1850618 dated Oct. 1, 2018, 2 pages.

* cited by examiner

EMERGENCY STOP DEVICE

CROSS-REFERENCE TO RELATED APPLICATIONS

The present application claims priority from French Application No. 1850618, filed Jan. 26, 2018, the disclosure of which is hereby incorporated herein by reference.

FIELD OF THE INVENTION

The present invention relates to an emergency stop device.

PRIOR ART

An electric machine generally comprises a panel having a first face (so-called front face) accessible by an operator and a second face (so-called rear face), opposite to the first face, not accessible to the operator.

For safety reasons, the electric circuit making it possible to operate the machine is arranged on the side of the rear face of the panel and may be controlled by one or more actuating devices (such as switches, keyboards, etc.) arranged on the front face of the panel. The panel is pierced to make it possible to connect these actuating device(s) electrically to the electric circuit.

In certain cases, the electric circuit is arranged at least in part on a printed circuit board (PCB).

The printed circuit board is generally arranged parallel to the panel. In order to minimise the size of the machine, it is generally sought to minimise the distance between the rear face of the panel and the front face of the printed circuit board arranged facing it.

For reasons of safety, the machine may comprise an emergency stop device making it possible, under the action of an operator, to open the electric circuit in order to cause the stoppage of the machine.

Such an emergency stop device typically comprises an electric module, comprising a contact actuator bearing a moveable contact able to ensure an electrical connection between two fixed contacts of the electric module, and an actuating module, comprising an actuator suited to transmit a pressing force exerted by a user to the contact actuator in order to displace the moveable contact and break the electrical connection between the two fixed contacts.

The document U.S. Pat. No. 8,003,909 describes such an emergency stop device.

In such a device, the printed circuit board is generally fixed on the rear face of the panel. This fixation is capable of deteriorating, for example due to vibrations that lead to wear or untightening of the parts, or incorrect implementation of the fixation system. Yet, since this fixation is not visible to a user, it is not possible to detect a potential failure, which could be capable of preventing the correct operation of the emergency stop device. This constitutes a significant safety problem with regard to the operation of the emergency stop device.

DESCRIPTION OF THE INVENTION

An aim of the invention is to design an emergency stop device that makes it possible to separate mechanically the electric module vis-à-vis the actuating module (for example with the aim of assembly or maintenance), while making secure the mechanical connection between these two modules once assembled in the machine.

To this end, the invention proposes an emergency stop device comprising:

an electric module suited to being soldered onto a printed circuit board, comprising a body, at least two fixed contacts arranged in the body and at least one contact actuator bearing a moveable contact able to electrically connect said fixed contacts, an actuating module suited to being mechanically coupled to the electric module and to being mounted on a panel, the actuating module comprising a body and an actuator moveable with respect to the body, the body comprising a so-called rear part able to extend through the panel on a side opposite to the actuator and to receive the electric module, the actuating module being able to be actuated by an operator between the following positions:

a rest position in which the moveable contact ensures an electrical connection between the fixed contacts, and an activated position in which the actuator exerts a depression force on the contact actuator so as to break the electrical connection between the fixed contacts, said device being characterised in that it comprises a locking system configured to secure in a reversible manner the mechanical coupling of the electric module to the actuating module.

"Reversible" is taken to mean the fact that the electric module may be separated from the actuating module without damaging the components of these two modules.

According to an embodiment, the locking system comprises a ring rotationally arranged around the body of the electric module between a locking position where the ring cooperates with the body of the actuating module to secure the electric module to the actuating module, and an unlocking position of the electric module vis-à-vis the actuating module.

According to an embodiment, the ring comprises a lug able to engage in a notch made in the rear part of the body of the actuating module to form a bayonet system.

According to an embodiment, the locking system comprises at least one elastic tongue extending from the body of the electric module and a corresponding notch made in the rear part of the body of the actuating module to secure the electric module to the actuating module by snapping.

According to another embodiment, the locking system comprises at least one toothed surface arranged on the body of the electric module facing a toothed surface arranged in the rear part of the body of the actuating module so as to ensure a securing of the electric module to the actuating module by friction of said surfaces.

Advantageously, the rear part of the body of the actuating module extends from a collar forming a bearing surface of said body on the front face of the panel.

According to an embodiment, the rear part of the body of the actuating module comprises a threaded surface able to cooperate with a nut to maintain the body of the actuating module on the panel between said collar and said nut.

According to an embodiment, the actuating module comprises a torsion and compression spring rotationally and translationally loading the actuator vis-à-vis the body to the rest position.

In a particularly advantageous manner, the actuating module comprises a cam path secured with the body and a finger extending from the actuator cooperating with said cam path when the actuating module is in the activated position, so as to guide the actuator to the rest position under the effect of a rotational movement applied to the actuator.

According to an embodiment, the body bears at least one latch loaded by a compression spring and the actuator bears an axle loaded by a compression spring, said axle having a first circumferential recess into which the latch engages when the actuating module is in rest position and a second circumferential recess further away from the panel into which the latch engages when the actuating module is in the activated position.

DESCRIPTION OF THE FIGURES

Other characteristics and advantages of the invention will become clear from reading the detailed description that follows, with reference to the appended drawings in which.

DETAILED DESCRIPTION OF EMBODIMENTS OF THE INVENTION

The invention proposes an emergency stop device having an actuating module and an electric module, the actuating module being separable from the electric module.

Figure 1:
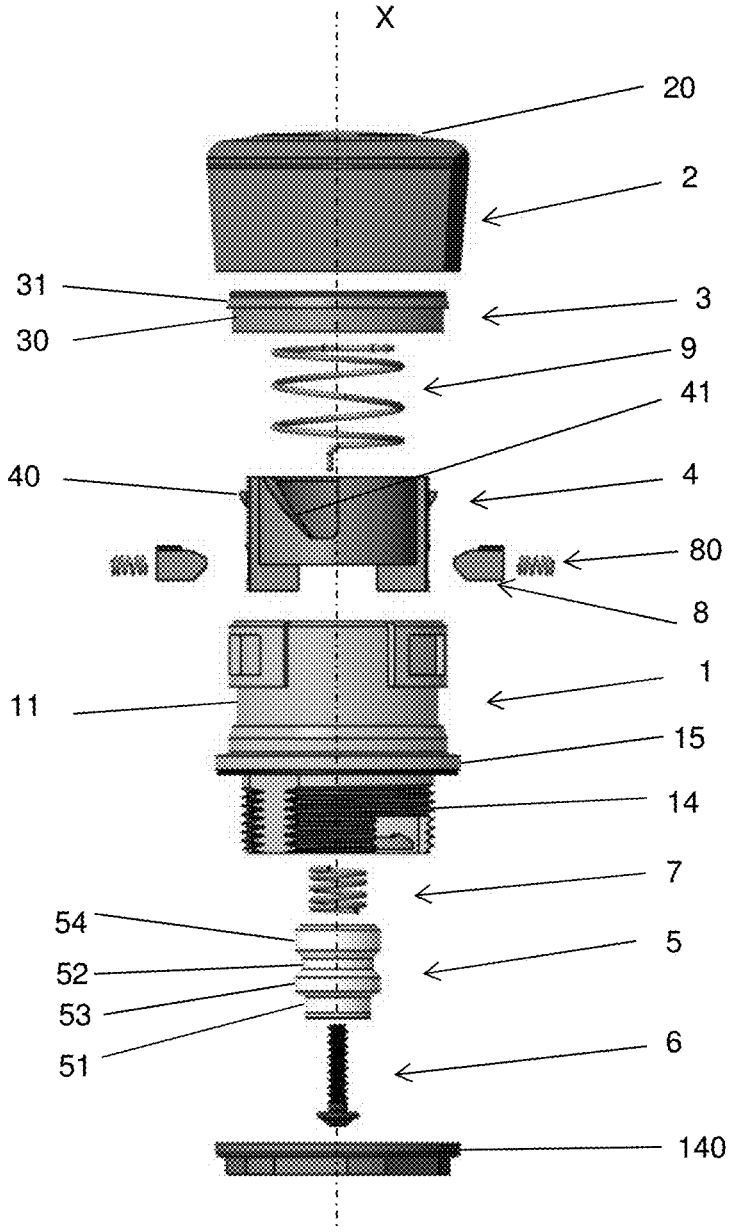
FIG. 1 is an exploded view of the actuating module of an emergency stop device according to an embodiment of the invention.
Figure 2:
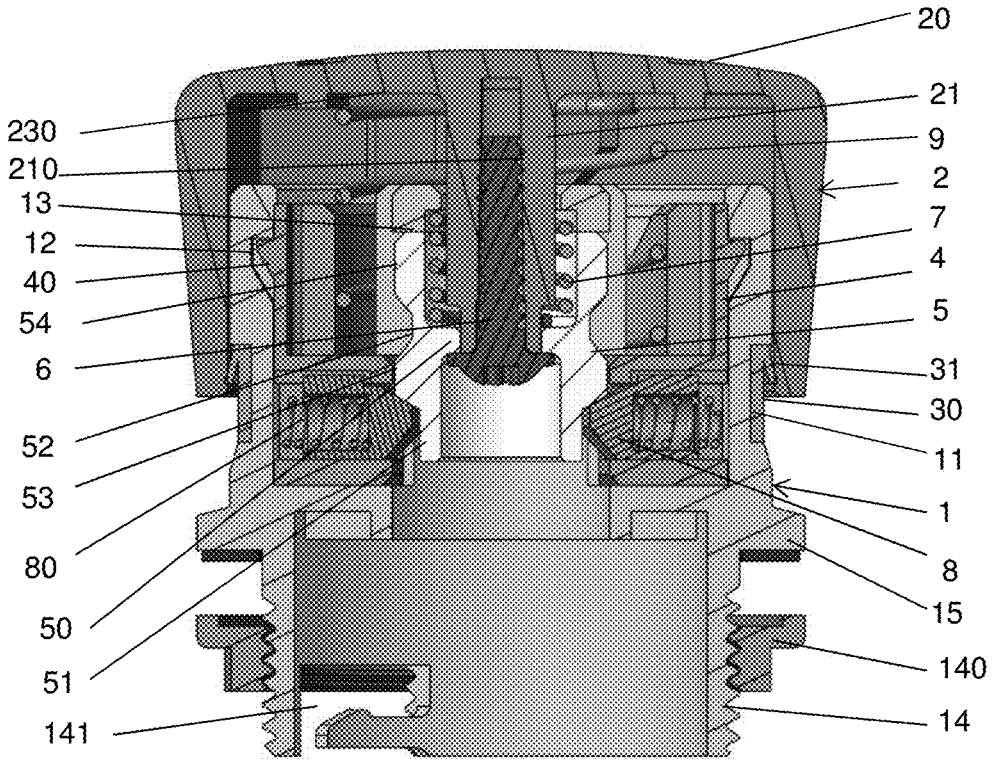
FIG. 2 is a sectional view of the assembled module of FIG. 1, in its rest position.

FIG. 1 is an exploded view of the actuating module according to an embodiment of the invention. FIG. 2 is a view of said assembled module in rest position (that is to say not having been actuated with a view to an emergency stop).

The actuating module comprises a body 1 and an actuator 2 translationally and rotationally moveable with respect to the body 1 along an axis X. In the remainder of the text, the terms "axial", "radial" and "transversal" are understood with respect to this axis X.

The actuator 2 is in the form of a push button, comprising a bearing zone 20 on which an operator can exert a pressure along the axis X in the case where the electric circuit has to be opened. The actuator 2 is hollow and covers a part of the body 1.

Advantageously, a seal 3 ensures a fluidic sealing between the body 1 and the actuator 2.

The seal 3 is typically in the form of a ring 30 from which an elastic lip 31 extends outwards.

The ring 30 is maintained in the body 1 in an annular groove 11.

When the actuating module is assembled, the seal 3 extends between the body 1 and the actuator 2, the lip 31 being compressed by the actuator 2 and thereby ensuring a fluidic sealing. Consequently, no fluid can penetrate inside the actuating module.

Figure 3:
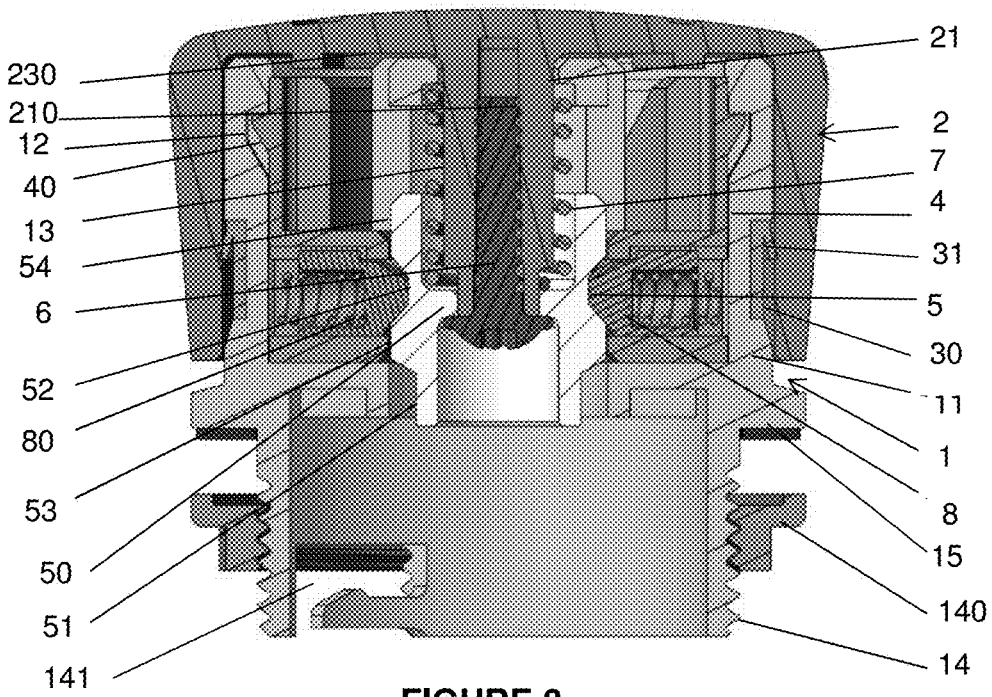
FIG. 3 is a sectional view of the assembled module of FIG. 1, locked in its activated position.

As may be seen more clearly in FIGS. 2 and 3, the actuator 2 has a central shaft 21 that extends inwards from the face 230 opposite to the bearing zone 20.

The central shaft 21 is hollow and has an inner surface 210.

This tapped inner surface 210 makes it possible to fix to the shaft 21 an axle 5 by means of a self-tapping screw 6.

The axle 5 is a hollow part that has a general revolution shape. Inside the axle 5 is arranged a transversal wall 50 having a passage opening for the threaded part of the screw 6, said opening having on the other hand a diameter less than the diameter of the head of the screw 6. The lower wall of the shaft 21 serves as stop for the head of the screw when the axle 5 is maintained on the shaft 21 by the screw 6. The outer surface of the axle 5 comprises two recesses 51, 52, the function of which will be explained hereafter. Each recess 51, 52 is set back in the radial direction with respect to an adjacent collar 53, 54. The recess 52 is thereby delineated by the collars 53 and 54, whereas the recess 51 is delineated uniquely on one side by the collar 53.

During the assembly of the actuating module, a return spring 7 is arranged between the outer face of the shaft 21 and the inner face of the axle 5, bearing on the one hand on the wall 50 of the axle and on the other hand on a collar 13 extending radially inside the body 1. The spring 7 is a compression spring. In the rest position illustrated in FIG. 2, the spring 7 is in the at least partially compressed state.

The body 1 is also hollow and has an inner housing for a cam 4.

The cam 4 is maintained inside the body 1. This maintaining may for example be achieved by snapping, thanks to the cooperation of two diametrically opposite lugs 40, projecting outwards from the cam 4, and a groove 12 that extends into the inner face of the body 1.

Advantageously, each lug 40 comprises an inclined part which facilitates the insertion of the cam into the body 1 (from above in the configuration as illustrated in FIG. 2) and a part substantially perpendicular to the axis X, which, once the lug is completely engaged in the groove 12, prevents extraction of the lug 40 outside of said groove 12.

The cam 4 has two diametrically opposite radial housings for two latches 8 and two respective springs 80. When the actuating module is assembled, each spring 80 is in the compressed state between the respective latch 8 and the inner wall of the body 1, so as to maintain the latch 8 inside the recess 51 of the axle 5 (cf. FIG. 2). It will be noted that the end of the latches on the side of the axle 5, as well as the edges of the collars 53, 54, advantageously have inclined surfaces.

Furthermore, a return spring 9 is arranged between the cam 4 and the actuator 2. The spring 9 is a torsion and compression spring, ensuring a rotational return of the actuator vis-à-vis the body, and a translational return of the actuator to the rest position vis-à-vis the body.

The cam 4 has on its outer face a cam path 41, the function of which will be detailed hereafter. As may be seen in FIGS. 4 and 5, the actuator comprises a finger 22 extending facing the cam path 41 when the actuating module is assembled.

The body 1 has a radial collar 15, from which extends, on the side opposite to the actuator 2, a part 14 having an outer threading, able to cooperate with a nut 140. As will be explained hereafter, the nut 140 makes it possible to fix the actuating module on the panel (not represented), the part 14 passing through an opening made in the panel, the collar 15 bearing on the front face of the panel and the nut 140 bearing on the rear face of the panel.

Furthermore, the electric module (not represented) is received inside the part 14.

FIG. 3 illustrates the actuating module of FIG. 2 in actuated position.

When the actuator 2 is pushed in by an operator along the axis X in the direction of the panel, the spring 9 compresses and the axle 5 which is secure with the shaft 21 moves in the direction of the panel (not represented) and the cooperation of the inclined surfaces of the collar 53 and the latches 8 has the effect of displacing the latches 8 radially outwards, against the force of the springs 80, so as to make them come out of the recess 51. At the same time, the spring 7 exerts a pushing force on the axle 5 in the direction of the panel. The actuating stroke is defined so that, at the latest when the face 230 opposite to the bearing zone 20 comes in abutment against the body 1, the recess 52 is facing the latches 8. The latches 8 are displaced inwards by the springs 80, until engaging in the recess 52. In this activated position, the spring 7 is in the free state (or less compressed than in the rest position). Furthermore, thanks to the engagement of the latches 8 in the recess 52, the actuator 2 is locked in the activated position, without possibility of returning to the rest position despite the return force of the spring 9.

An action of an operator is thus necessary to bring the actuating device back to its initial rest position. This action will now be explained with reference to FIGS. 4 and 5. In these figures, certain parts have been represented in transparent form in order to make the locking mechanism easier to understand.

Figure 4:
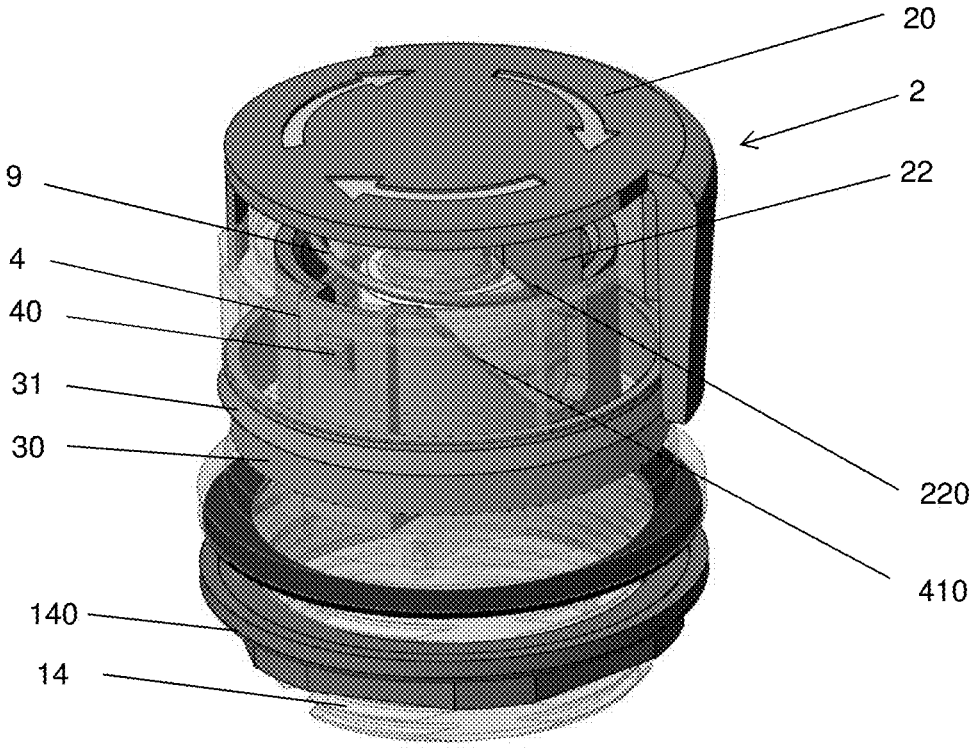
FIG. 4 is a perspective view of the actuating module in its rest position.

FIG. 4 is a perspective view of the actuating module in rest position. In this position, the finger 22 of the actuator is not in contact with the cam path 41.

Figure 5:
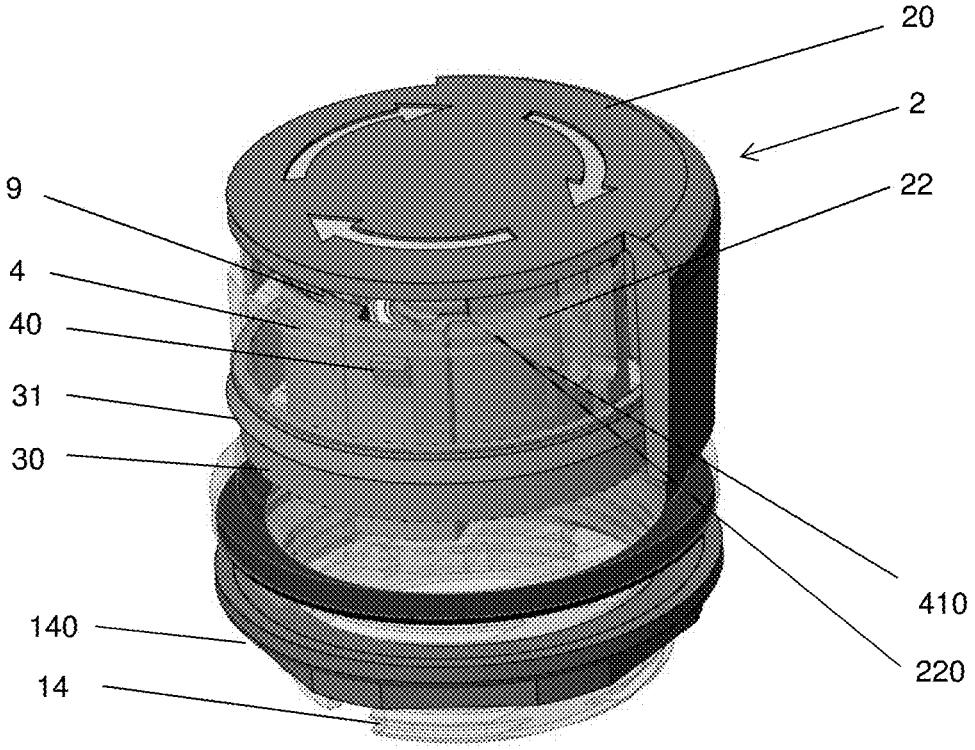
FIG. 5 is a perspective view of the actuating module in the course of unlocking.

FIG. 5 illustrates the actuating module in the course of a rotational movement applied to the actuator 2 by an operator (not represented) around the axis X. During this rotation (the direction of which is indicated to the operator by arrows represented on the bearing zone 20), the finger 22 of the actuator comes into contact against the cam path 41 of the cam 4. The rotation of the actuator has the effect of placing in contact the inclined surface 220 of the finger 22 with a surface 410 inclined in the same direction of the cam path 41, then to slide the surface 220 along the surface 410, which makes it possible to displace the actuator in the moving away direction vis-à-vis the body 1 according to a substantially helicoidal movement with respect to the body. The axle 5, which is maintained with the actuator 2 by a screw 6, is animated by a translational movement along the axis X with respect to the body 1, which has the effect of disengaging the latches 8 from the recess 52 against the return force of the springs 80 and bringing the recess 51 facing the latches 8, while compressing the spring 7. The latches 8 are then displaced inwards by the springs 80, until engaging in the recess 51. Thanks to the engagement of the latches 8 in the recess 51, the actuator 2 is maintained in rest position despite the force of the spring 7.

The actuating module is then once again in the rest position represented in FIG. 2.

The electric module and its mode of fixation to the actuating module will now be described.

Figure 6:
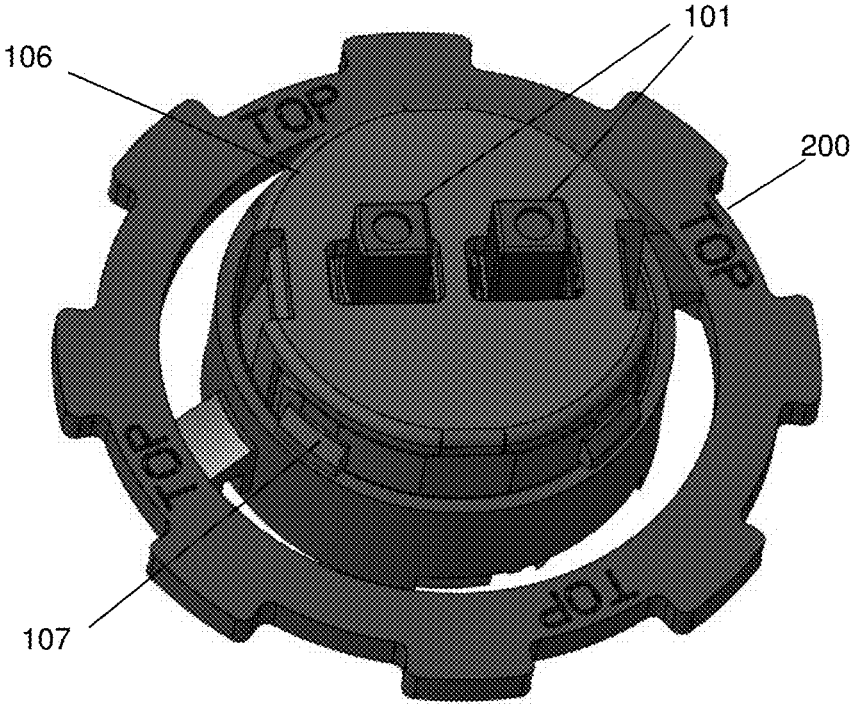
FIGS. 6 and 7 are respectively perspective and sectional views of the electric module equipped with an unlocking ring.
Figure 7:
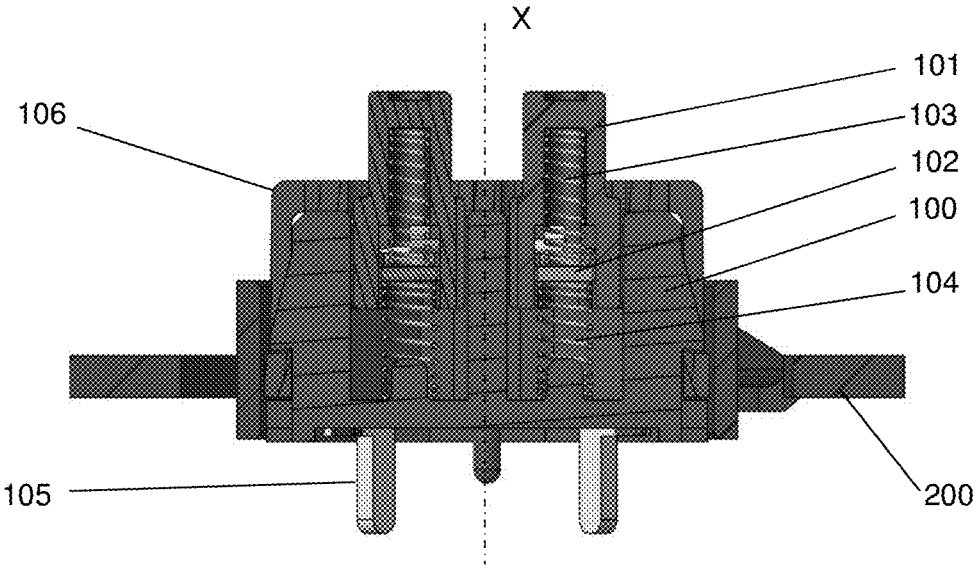

FIGS. 6 and 7 illustrate a perspective view and a sectional view of the electric module and a locking ring making it possible to secure the electric module to the actuating module in a reversible manner. This ring constitutes a first embodiment of the locking system.

The electric module has a shape and dimensions enabling its insertion at least in part inside the part 14 of the body 1.

In a manner known per se, the electric module comprises a body 100 in which are arranged two contact actuators 101 and output connecting terminals 105 connected to fixed contacts (not represented). Each contact actuator supports a moveable contact 102 suited to establishing an electrical connection between two fixed contacts, the moveable contact being maintained between an actuator spring 103 on the one hand and a contact spring 104 on the other hand. When the emergency stop device is assembled, the actuators 101 are facing the axle 5. Each actuator is translationally moveable along the axis X between a rest position in which the moveable contact ensures an electrical connection between the fixed contacts (the axle 5 being distant from the actuator 101), and a pushed in position (under the action of a pressure exerted by the axle 5) in which the moveable contact is moved away from the fixed contacts, interrupting the electrical connection between the two fixed contacts.

The body 100 is closed by a cover 106 through which extend the contact actuators 101.

A locking ring 200 is mounted outside of the body 101 while being able to turn around the axis X. The function of said ring will be detailed hereafter.

The electric module is soldered onto a printed circuit board (visible in FIGS. 8 to 11) before the assembly of the emergency stop device, the output connecting terminals ensuring an electrical connection between the printed circuit board and the electric module (for example by tin soldering with a standard process).

Other types of connection of the electric module could be implemented with different connecting terminals: connection with soldered wires or connecting terminals for rapid connections or connector.

Figure 8:
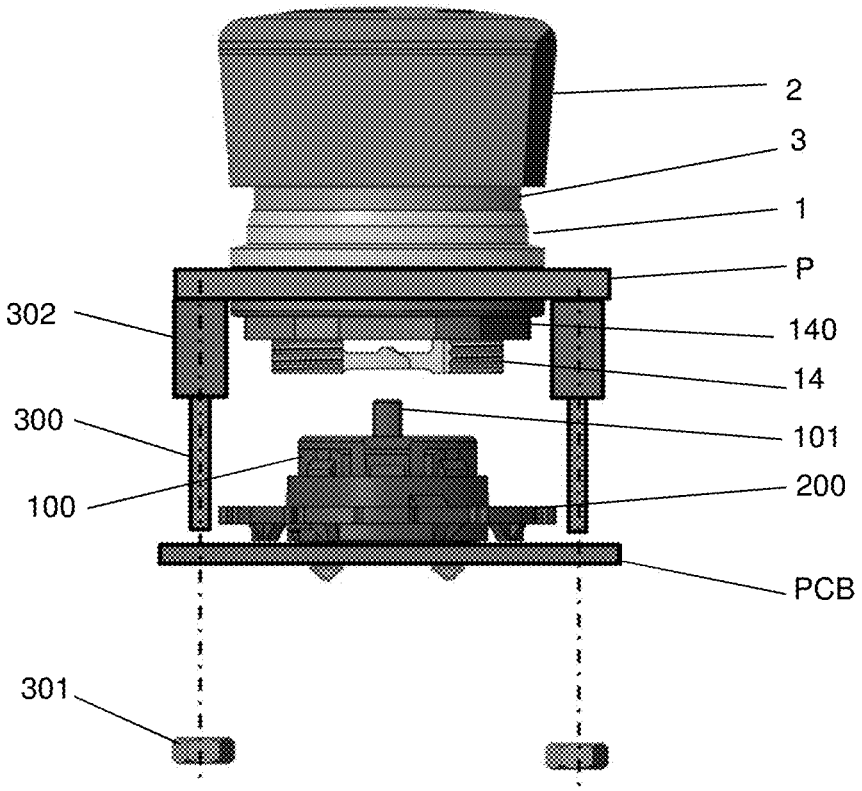
FIGS. 8 and 9 illustrate an example of method for assembling the emergency stop device.
Figure 9:
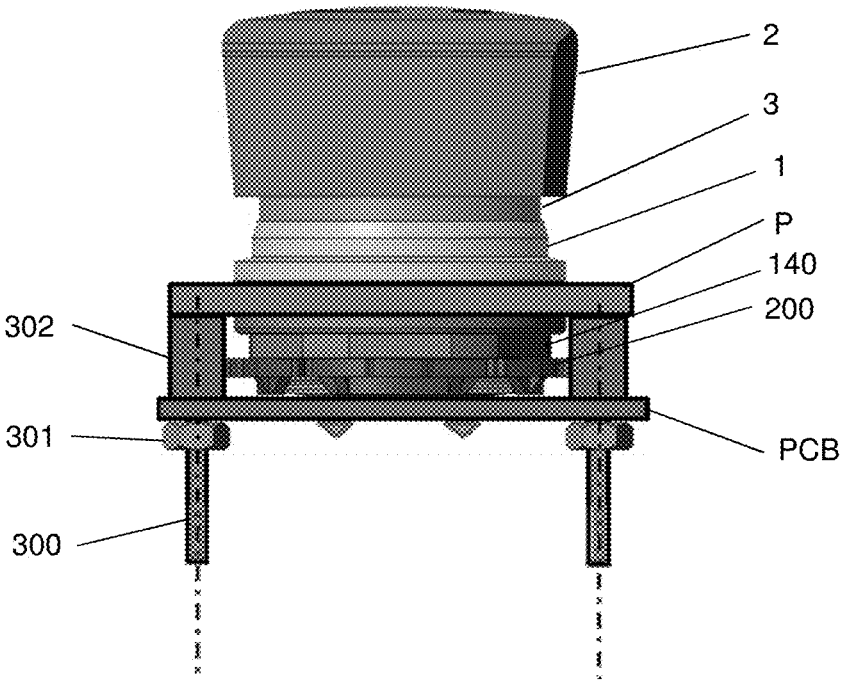

FIGS. 8 and 9 illustrate an example of assembly of the electric module and the actuating module vis-à-vis the panel.

FIG. 8 is an exploded view of the main components before final assembly.

The actuating module is mounted on the panel P by inserting, through the front face of the panel, the part 14 of the body into a through opening, and by fixing the nut 140 on the threaded part of the part 14 of the rear side of the panel. The actuating module is then rigidly secured to the panel.

The electric module soldered onto the printed circuit board PCB and provided with the locking ring 200 is presented on the rear side of the panel P, facing the part 14 of the body 1 of the actuating module.

Threaded rods 300 extend from the rear face of the panel P, facing corresponding openings in the printed circuit board PCB.

Spacers 302 secured with the threaded rods are intended to ensure a determined distance between the panel P and the printed circuit board PCB.

Once the printed circuit board is engaged on the threaded rods 300, and the electric module is inserted at least in part in the part 14 of the body, nuts 301 are fixed on the threaded rods in order to secure the electric module to the panel P (cf. FIG. 9).

In the event of failure of the threaded rods 300 and nuts 301, the electric module could be disengaged at least in part from the actuating module, such that a pressure on the actuator would not make it possible to open the electric circuit. Such a failure intervening on the panel rear, it would not be visible by an operator, and the failure of the emergency stop device could not be detected.

To avoid this risk, the invention proposes a locking system that makes it possible to secure the fixation of the electric module to the actuating module while ensuring a direct and reversible mechanical coupling between the two modules. Thus, even in the event of failure of the fixation of the printed circuit board on the panel, the locking system maintains the electric module in its operational position with respect to the actuating module, such that the functionality of the emergency stop device is preserved.

Furthermore, by being reversible, the locking system makes it possible to separate the electric module from the actuating module, for example for maintenance purposes, while leaving the actuating module in place on the panel.

This locking system makes it possible to mount the electric module on the printed circuit board on an automatic assembly line, then to secure together the printed circuit board and the electric module on the actuating module on the rear of the panel. The electric module and the actuating module may be supplied separately and be coupled directly during the assembly of the emergency stop device on the panel.

Figure 11:
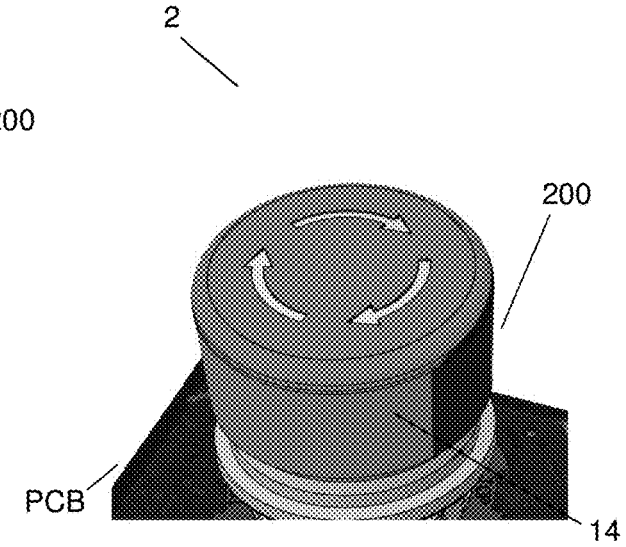
Figure 12:
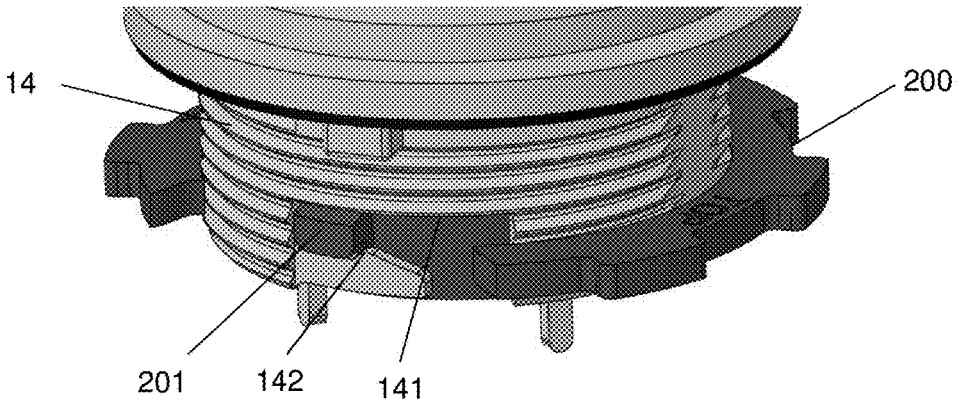

According to a first embodiment, the locking system comprises a ring, the operation of which is explained with reference to FIGS. 10 to 12.

Figure 10:
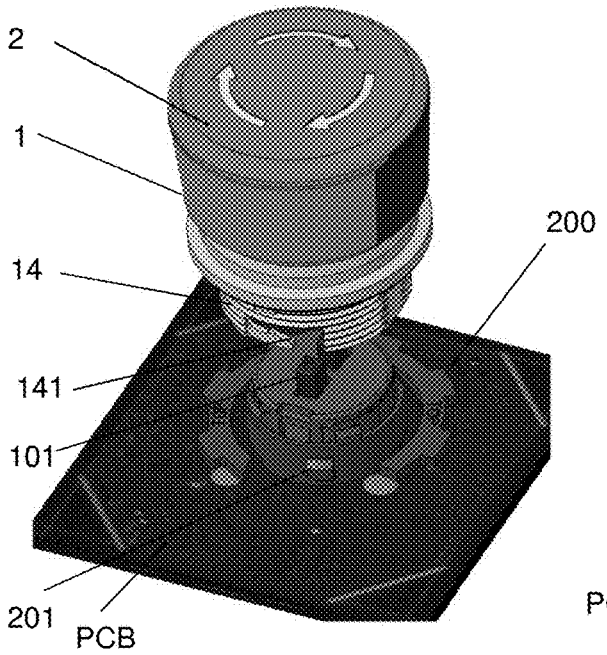
FIGS. 10 to 12 illustrate a first example of the principle of locking the electric module vis-à-vis the actuating module.

When the electric module is presented facing the actuating module mounted on the panel (the panel not being represented in order to make the figures easier to understand), a bent notch 141 formed at the base of the part 14 of the body 1 is facing a lug 201 of the locking ring, so as to enable the insertion of the lug 201 into said notch 141 in the direction of the axis X (cf. FIG. 10).

The body 1 is equipped with two systems of notches 141 diametrically opposite with respect to the axis X.

A rotation of the ring (in the clockwise direction in the configuration illustrated in FIGS. 10 to 12) makes it possible to displace the lug 201 in the transversal part of the notch 141, up to a stop 142 (cf. FIGS. 11 and 12), according to a bayonet mechanism. The ring 200 then ensures a locking of the actuating module vis-à-vis the electric module.

To separate the actuating module from the electric module, an operator has to turn the ring 200 in the opposite direction to that of locking, in order to release the lug 201 from the notch 141. To this end, the ring advantageously has shapes facilitating its handling, manually or using a tool.

At the end of this separating, the actuating module remains fixed to the panel, but the printed circuit board and the electric module (which remains secured to the printed circuit board) may be dismantled from the panel after unscrewing the nuts 301.

The ring 200 being situated on the rear side of the panel, it is not accessible through the front face of the panel and thus only allows an unlocking through the rear face, which makes the dismantling conditions secure.

Figure 13:
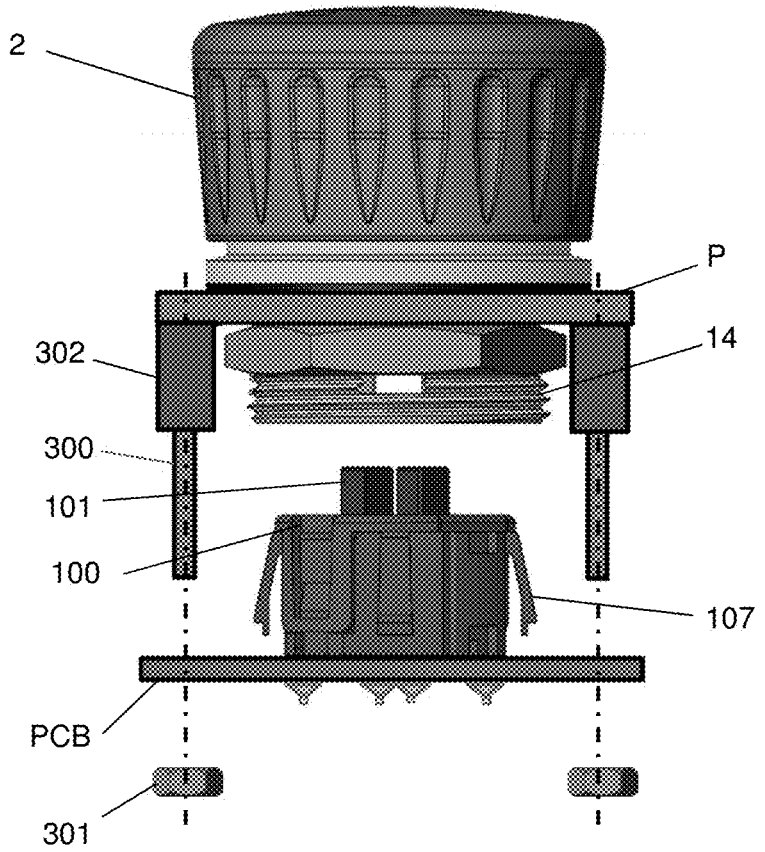
FIGS. 13 and 14 illustrate a second example of the principle of locking the electric module vis-à-vis the actuating module.
Figure 14:
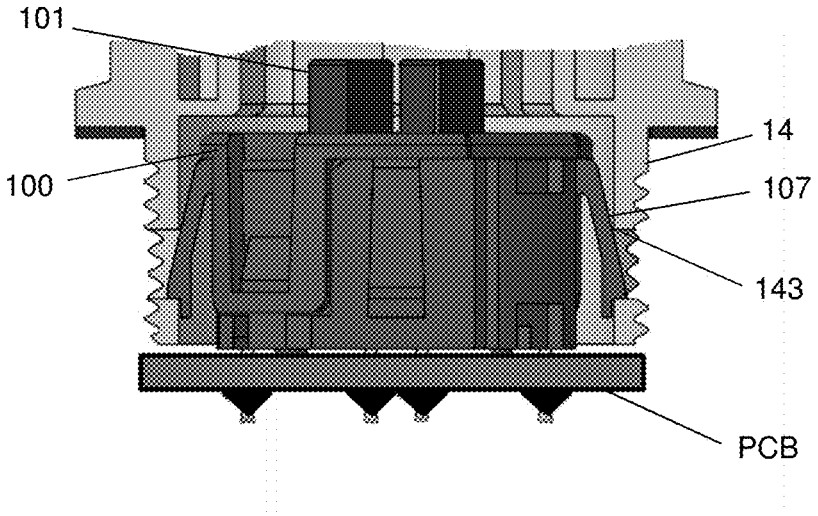

FIGS. 13 and 14 illustrate a second embodiment of the locking system, relying on a snap mounting of the electric module on the actuating module.

Apart from the locking system, the actuating and electric modules are identical to those described above, the reference signs already used in FIGS. 1 to 12 designating the same components.

The locking system comprises at least one elastic tongue 107 that extends from the body 100 of the electric module, and a corresponding notch 143 made inside the rear part 14 of the body 1 of the actuating module. Advantageously, the tongues are two in number and are diametrically opposite. When the electric module is assembled in the rear part 14 of the actuating module, the tongues are compressed then engage in the notches 143 of the body 1 of the actuating module. The electric module is thereby retained mechanically in a secure manner by the actuating module.

Advantageously, the notches 143 are through notches, which makes it possible to facilitate the dismantling of the electric module by exerting a compressive force on the tongues 107 from the outside of the device.

Conversely, the elastic tongue(s) could be arranged on the body of the actuating module, and the corresponding aperture(s) could be formed in the body of the electric module.

As in the preceding embodiment, the locking system is situated on the rear of the panel, and is thus not accessible by a user of the machine.

Figure 15:
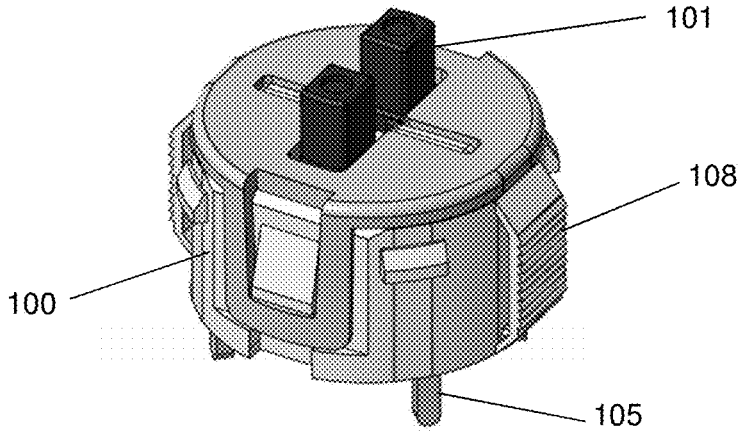
FIGS. 15 and 16 illustrate a third example of the principle of locking the electric module vis-à-vis the actuating module.
Figure 16:
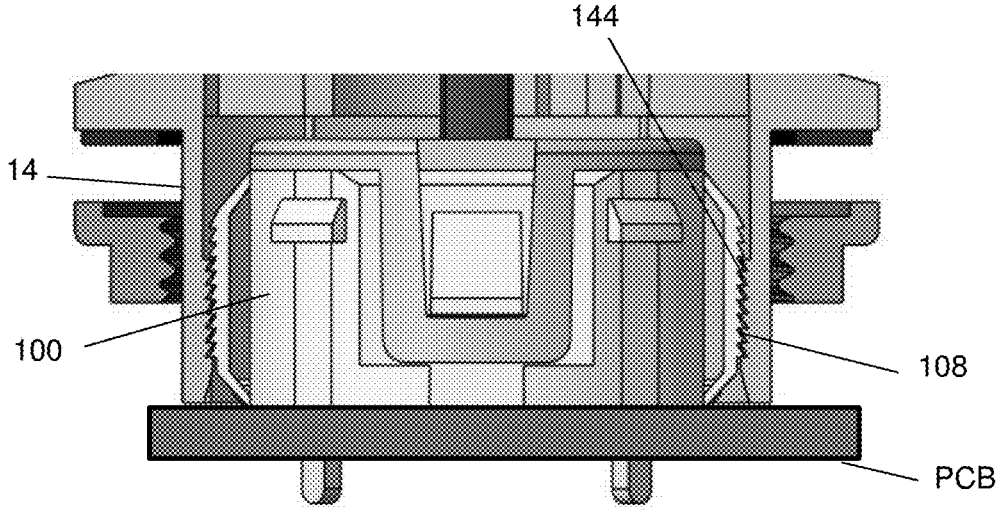

FIGS. 15 and 16 illustrate a third embodiment of the locking system, relying on an engagement by friction of the electric module on the actuating module.

Apart from the locking system, the mechanical and electric modules are identical to those described above, the reference signs already used in FIGS. 1 to 12 designating the same components.

The locking system comprises at least one toothed surface 108 on the body 100 of the electric module, and a complementary toothed surface 143 inside the rear part 14 of the body of the actuating module. Advantageously, the toothed surfaces are two in number for each module and are diametrically opposite. The slots are oriented so as to enable the insertion of the electric module into the actuating module but to engage together mutually once the electric module is assembled in the rear part 14 of the actuating module, so as to oppose removal of the electric module. The height and the slope of the slots are chosen as a function of the desired mechanical strength.

As in the preceding embodiments, the locking system is situated on the rear of the panel, and is thus not accessible by a user of the machine.

It goes without saying that the invention is not limited to the particular shape of the different components illustrated in the figures, and that any other means making it possible to fulfil the same function as these different components may be employed without however going beyond the scope of the present invention, as indicated in FIGS. 15 and 16.

REFERENCES

U.S. Pat. No. 8,003,909

The invention claimed is:

1. An emergency stop device, comprising:

an electric module configured to be soldered onto a printed circuit board, comprising a body, at least two fixed contacts arranged in the body and at least one contact actuator bearing a moveable contact able to connect said fixed contacts electrically, an actuating module configured to be mechanically coupled to the electric module and to be mounted on a panel, the actuating module comprising a body and an actuator moveable with respect to the body, the body comprising a rear part able to extend through the panel on a side opposite to the actuator and to receive the electric module, the actuating module being able to be actuated by an operator between the following positions:

a rest position in which the moveable contact ensures an electrical connection between the fixed contacts, and an activated position in which the actuator exerts a depression force on the contact actuator so as to break the electrical connection between the fixed contacts, said device further comprising a locking system configured to secure in a reversible manner the electric module to the actuating module, wherein the locking system comprises a ring rotationally arranged around the body of the electric module between a locking position where the ring cooperates with the body of the actuating module to secure the electric module to the actuating module, and an unlocking position of the electric module vis-à-vis the actuating module.

2. The emergency stop device of claim 1, wherein the ring comprises a lug able to engage in a notch made in the rear part of the body of the actuating module to form a bayonet system.

3. The emergency stop device of claim 1, wherein the locking system comprises at least one elastic tongue extending from the body of the electric module and a corresponding notch made in the rear part of the body of the actuating module to secure the electric module to the actuating module by snapping.

4. The emergency stop device of claim 1, wherein the locking system comprises at least one toothed surface arranged on the body of the electric module facing a toothed surface arranged in the rear part of the body of the actuating module so as to ensure a securing of the electric module to the actuating module by friction of said surfaces.

5. The emergency stop device of claim 1, wherein the rear part of the body of the actuating module extends from a collar forming a bearing surface of said body on the front face of the panel.

6. The emergency stop device of claim 5, wherein the rear part of the body of the actuating module comprises a threaded surface able to cooperate with a nut to maintain the body of the actuating module on the panel between said collar and said nut.

7. The emergency stop device of claim 1, wherein the actuating module comprises a torsion and compression spring rotationally and translationally loading the actuator vis-à-vis the body to the rest position.

8. The emergency stop device of claim 1, wherein the actuating module comprises a cam path secured with the body and a finger extending from the actuator cooperating with said cam path when the actuating module is in the activated position, so as to guide the actuator to the rest position under the effect of a rotational movement applied to the actuator.

9. The emergency stop device of claim 1, wherein the body bears at least one latch loaded by a compression spring and the actuator bears an axle loaded by a compression spring, said axle having a first circumferential recess into which the latch engages when the actuating module is in rest position and a second circumferential recess further away from the panel into which the latch engages when the actuating module is in the activated position.

10. The emergency stop device of claim 1, wherein the locking system is configured to directly secure in a reversible manner the electric module to the actuating module.

11. An emergency stop device, comprising:

an electric module configured to be soldered onto a printed circuit board, comprising a body, at least two fixed contacts arranged in the body and at least one contact actuator bearing a moveable contact able to connect said fixed contacts electrically, an actuating module configured to be mechanically coupled to the electric module and to be mounted on a panel, the actuating module comprising a body and an actuator moveable with respect to the body, the body comprising a rear part able to extend through the panel on a side opposite to the actuator and to receive the electric module, the actuating module being able to be actuated by an operator between the following positions:

a rest position in which the moveable contact ensures an electrical connection between the fixed contacts, and an activated position in which the actuator exerts a depression force on the contact actuator so as to break the electrical connection between the fixed contacts, said device further comprising a locking system configured to secure in a reversible manner the electric module to the actuating module, wherein the rear part of the body of the actuating module extends from a collar forming a bearing surface of said body on the front face of the panel, said rear part comprising a threaded surface able to cooperate with a nut to maintain the body of the actuating module on the panel between the collar and the nut.

12. The emergency stop device of claim 11, wherein the locking system comprises a ring rotationally arranged around the body of the electric module between a locking position where the ring cooperates with the body of the actuating module to secure the electric module to the actuating module, and an unlocking position of the electric module vis-à-vis the actuating module.

13. The emergency stop device of claim 12, wherein the ring comprises a lug able to engage in a notch made in the rear part of the body of the actuating module to form a bayonet system.

14. The emergency stop device of claim 11, wherein the locking system comprises at least one elastic tongue extending from the body of the electric module and a corresponding notch made in the rear part of the body of the actuating module to secure the electric module to the actuating module by snapping.

15. The emergency stop device of claim 11, wherein the locking system comprises at least one toothed surface arranged on the body of the electric module facing a toothed surface arranged in the rear part of the body of the actuating module so as to ensure a securing of the electric module to the actuating module by friction of said surfaces.

16. The emergency stop device of claim 11, wherein the actuating module comprises a torsion and compression spring rotationally and translationally loading the actuator vis-à-vis the body to the rest position.

17. The emergency stop device of claim 11, wherein the body bears at least one latch loaded by a compression spring and the actuator bears an axle loaded by a compression spring, said axle having a first circumferential recess into which the latch engages when the actuating module is in rest position and a second circumferential recess further away from the panel into which the latch engages when the actuating module is in the activated position.

18. An emergency stop device, comprising:

an electric module configured to be soldered onto a printed circuit board, comprising a body, at least two fixed contacts arranged in the body and at least one contact actuator bearing a moveable contact able to connect said fixed contacts electrically, an actuating module configured to be mechanically coupled to the electric module and to be mounted on a panel, the actuating module comprising a body and an actuator moveable with respect to the body, the body comprising a rear part able to extend through the panel on a side opposite to the actuator and to receive the electric module, the actuating module being able to be actuated by an operator between the following positions:

a rest position in which the moveable contact ensures an electrical connection between the fixed contacts, and an activated position in which the actuator exerts a depression force on the contact actuator so as to break the electrical connection between the fixed contacts, said device further comprising a locking system configured to secure in a reversible manner the electric module to the actuating module, wherein the actuating module comprises a cam path integral with the body and a finger extending from the actuator cooperating with said cam path when the actuating module is in the activated position, so as to guide the actuator to the rest position under the effect of a rotational movement applied to the actuator.

* * * * *